US007228836B2

(12) United States Patent
Horimura et al.

(10) Patent No.: US 7,228,836 B2
(45) Date of Patent: Jun. 12, 2007

(54) SPRING RETAINER AND METHOD FOR MANUFACTURING THE SAME

(75) Inventors: Hiroyuki Horimura, Wako (JP); Kosuke Doi, Wako (JP); Yoshikazu Kanazawa, Toyama (JP); Masahiro Sawai, Toyama (JP)

(73) Assignees: Honda Motor Co., Ltd., Tokyo (JP); Tanaka Seimitsu Kogyo Co., Ltd., Toyama (JP)

( * ) Notice: Subject to any disclaimer, the term of this patent is extended or adjusted under 35 U.S.C. 154(b) by 0 days.

(21) Appl. No.: 11/236,092

(22) Filed: Sep. 27, 2005

(65) Prior Publication Data

US 2006/0067851 A1 Mar. 30, 2006

(30) Foreign Application Priority Data

Sep. 29, 2004 (JP) ..... 2004-283228
Jul. 5, 2005 (JP) ..... 2005-196479

(51) Int. Cl.
*F01L 1/00* (2006.01)
*B21K 1/22* (2006.01)

(52) U.S. Cl. ..... 123/188.12; 29/888.4

(58) Field of Classification Search ..... 123/188.12; 29/888.4
See application file for complete search history.

(56) References Cited

U.S. PATENT DOCUMENTS 5,051,140 A * 9/1991 Mushiake et al. ..... 148/281

FOREIGN PATENT DOCUMENTS

| | | | |
|---|---|---|---|
| EP | 0 985 806 A3 | | 3/2000 |
| JP | 01240639 A | * | 9/1989 |
| JP | 7-180013 | | 7/1995 |

OTHER PUBLICATIONS

"Development of Titanium Alloy Valve Spring Retainers", Mushiake et al., SAE Special Publications, No. 864, Feb. 25, 1991, pp. 41-49, XP009046186.

* cited by examiner

*Primary Examiner*—Noah P. Kamen
(74) *Attorney, Agent, or Firm*—Hamre, Schumann, Mueller & Larson, P.C.

(57) ABSTRACT

A spring retainer formed from a titanium alloy and comprising a cylinder and a brim formed integrally with the cylinder is disclosed. The brim has on a top thereof a slope formed such that a thickness of the brim decreases radially outwardly.

7 Claims, 9 Drawing Sheets

CONFIGURATION A

CONFIGURATION B

CONFIGURATION C

CONFIGURATION D

SPRING RETAINER AND METHOD FOR MANUFACTURING THE SAME

FIELD OF THE INVENTION

The present invention relates to an improvement in a valve spring retainer for an engine and a method for manufacturing the retainer.

BACKGROUND OF THE INVENTION

A valve spring retainer for engine acts to receive an end of a valve spring, and retain intake/exhaust valves and a cotter fitted in the valves, which are located inside the retainer, so that the valve spring does not unfasten during operation of the valves.

JP-A-7-180013, for example, proposes a valve spring retainer for engine using a Ti-6Al-4V-based Ti alloy as a material. The valve spring retainer is now described with reference to FIG. 11 hereof.

As shown in FIG. 11, the valve spring retainer for engine 200 has a through-hole 201 through which valves aligned along an axis pass, and receiving parts 202, 203 for supporting the valve spring at a periphery of the through-hole.

JP-A-7-180013 discloses a technique for hot-forming the Ti-6Al-4V-based Ti alloy at 300 to 800° C. into a certain shape.

Furthermore, JP-A-7-180013 discloses a technique for cold-forming a Ti-4Al-22V-based Ti alloy at about 200° C. into a certain shape.

However, the Ti-6Al-4V-based α/β Ti-alloy has the problem that since it must be formed by hot forging, finishing is necessary to improve dimension accuracy or obtain a smooth surface, which increases production cost due to increase in number of steps and the like.

On the other hand, the Ti-4Al-22V-based Ti alloy is a β-type Ti alloy, which is formed by cold rolling, and therefore a product with excellent shape is obtained. However, the β-type Ti alloy has the problem that the material is expensive, and that the life of the metal mold is short because of high deformation resistance in forging, resulting in increase in cost of the valve spring retainer for engine.

SUMMARY OF THE INVENTION

According to an aspect of the present invention, there is provided a spring retainer for retaining one end of a valve spring for biasing intake/exhaust valves to a closed position, which comprises a cylinder and a brim formed integrally with the cylinder and extending radially outwardly from an upper end of the cylinder, wherein the spring retainer comprises a titanium alloy formed on a top of the brim by cold forging at least upon finishing, and a slope made by compressing the brim obliquely downwardly during the cold forging such that the brim has a thickness decreasing in a radially outward direction.

In this way, the brim top is compressed obliquely downwardly during the cold forging so that the thickness of the brim decreases in a radially outward direction. As a result, even if an α-type titanium alloy having large deformation anisotropy is used as a material, when the retainer is formed by cold forging, shrinkage, which tends to be generated at the brim base where a lower surface of the brim intersects with an outer peripheral surface of the cylinder, can be suppressed, and anisotropy of the outer diameter can be also suppressed. Consequently, it becomes possible to mass-produce valve spring retainers made of titanium alloy, which are high in strength and inexpensive.

Preferably, the titanium alloy comprises an α-type titanium alloy containing 0.5 to 1.5 mass percent of iron and 0.2 to 0.5 mass percent of oxygen in addition to titanium, and contains other inevitable impurities. Accordingly, the cost of the alloy material becomes less than that of the Ti-6Al-4V alloy or the Ti-4Al-22V alloy.

Desirably, the titanium alloy comprises an α-type titanium alloy containing 0.5 to 1.5 mass percent of iron, 0.2 to 0.5 mass percent of oxygen, and 0.01 to 0.06 mass percent of nitrogen in addition to titanium, and contains other inevitable impurities. Therefore, material cost in the alloy can be reduced compared with the Ti-6Al-4V alloy or the Ti-4Al-22V alloy, and this alloy containing N can have greater strength than a α-type titanium alloy without N.

In a preferred form, the slope formed on the brim runs radially outwardly from a position only a distance t away from an outer peripheral surface of the cylinder. The distance may be set on the basis of $(0.395D-0.5d) \leqq t \leqq (0.453D-0.5d)$, where D is an outer diameter of the brim and d is an outer diameter of the cylinder. Accordingly, t is set to fall within the range in which the anisotropy of deformation can be securely suppressed.

Preferably, the brim has a distal end of a width set to fall within a range of 41% to 70% of a maximum thickness of the brim. When it is less than 41%, a defective shape appears at the edge of the brim, and when it exceeds 70%, the effect of suppressing anisotropy of the slope becomes insufficient. Thus, in each case, the spring retainer has a bad shape. For these reasons, the thickness of the edge of the brim is set to 41% to 70% of the maximum thickness of the brim, and thereby a spring retainer having an excellent shape can be obtained.

It is desirable that the brim has a relief portion of a constant thickness formed at an outer edge or peripheral end thereof. With the relief portion, the deformation anisotropy is sufficiently suppressed, and therefore uniformity of the outer diameter of the brim is improved.

Desirably, the relief portion has a width set to be at most 30% of a length of the slope formed on the brim. With this, the deformation anisotropy can be sufficiently suppressed, and the uniformity of the outer diameter can be improved with certainty without reducing the degree of freedom in the shape of the slope formed on the brim.

According to another aspect of the present invention, there is provided a method for manufacturing a spring retainer which comprises a cylinder and a brim projecting outwardly therefrom and is designed for supporting one end of a valve spring with an outer peripheral surface of the cylinder and a lower surface of the brim, the method comprising the steps of cutting a titanium blank in the form of a wire or rod to obtain a forming material, upsetting the forming material placed in a recess of a die of a metal mold by a bottom surface of a punch, punching a hole in the upset piece after the upsetting, obtaining a preform by cold forging the punched piece placed in the recess of the die using a punch, and forming the brim such that a thickness of the brim decreases in a radially outward direction by cold forging the preform placed in the recess of the die using the punch.

In this way, the spring retainer is manufactured through at least five stages: cutting the wire rod or the stick of titanium to make the forming material in the first step, upsetting the forming material in the second step, punching a hole in the material in the third step, cold-forging it into the preform in the fourth step, and then cold-forging the piece to obtain the spring retainer as a fifth step.

Since cold forging is used in the method, a finished forming product of the spring retainer can be completed without post-machining such as grinding after final forging.

Moreover, the brim is compressed obliquely downward in cold forging so that the thickness of the brim is decreased in a radially outward direction, so that material flow at the brim can be made uniform, and thus a spring retainer having high uniformity of outer diameter can be obtained.

BRIEF DESCRIPTION OF THE DRAWINGS

Certain preferred embodiments of the present invention will now be described, by way of example only, with reference to the accompanying drawings, in which.

DETAILED DESCRIPTION OF THE PREFERRED EMBODIMENTS

Figure 1:
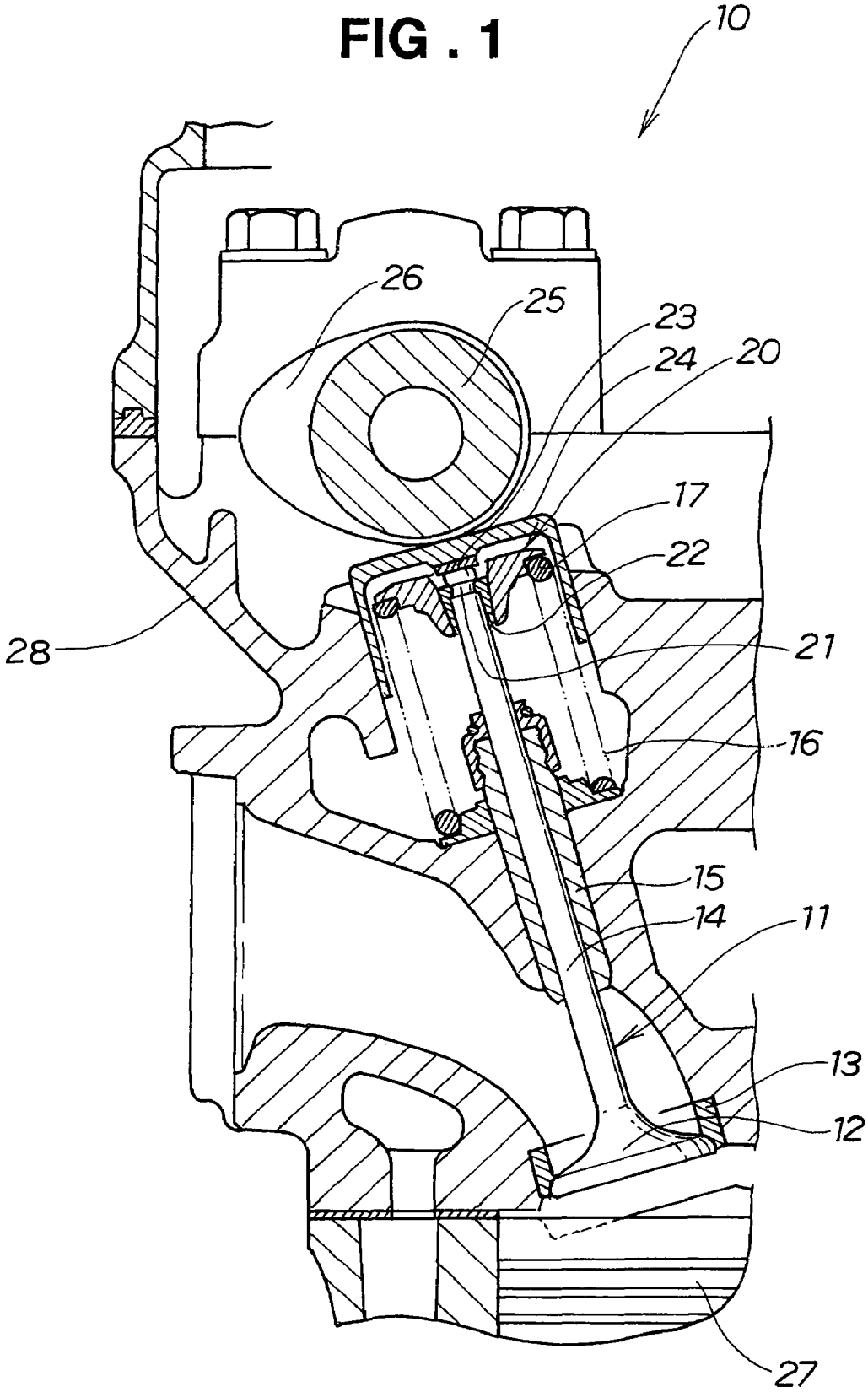
FIG. 1 is a sectional view showing an example of a valve operating mechanism including a spring retainer.

A valve operating mechanism 10 shown in FIG. 1 comprises a valve seat 13 for receiving a valve head 12 of an intake valve (or exhaust valve) 11; a valve stem 14 extending upward from the valve head 12; a valve guide 15 for guiding the valve stem 14; a valve spring 16 for biasing the intake valve 11 to the closed position; a spring retainer 20 for retaining one end 17 of the valve spring 16; a cotter 22 that is located inside the spring retainer 20 and fits in an upper recess 21 of the valve stem 14; an inner shim 23 provided at the upper end of the valve stem 14; a lifter 24 that covers the valve stem 14, valve spring 16, spring retainer 20, cotter 22 and inner shim 23; and a cam shaft 25 having a cam 26 which contacts with the lifter 24.

Reference numeral 27 indicates a piston, and 28 indicates a cylinder head.

Figure 2A:
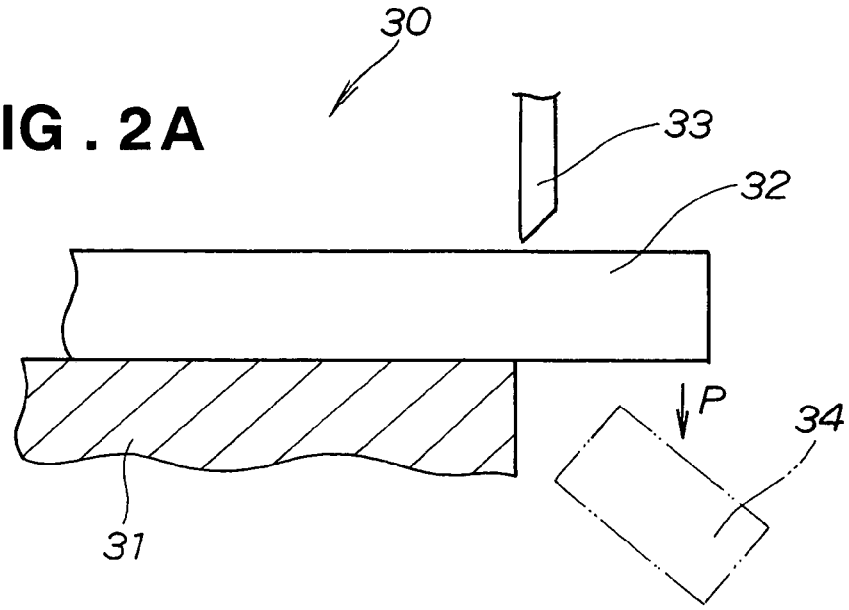
FIG. 2A to FIG. 2C are views showing processes from cutting of a titanium rod to hole punching during cold forming.
Figure 2B:
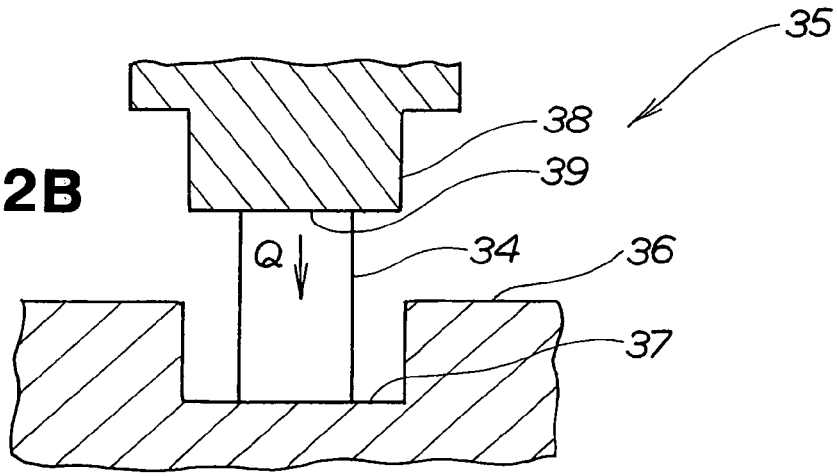
Figure 2C:
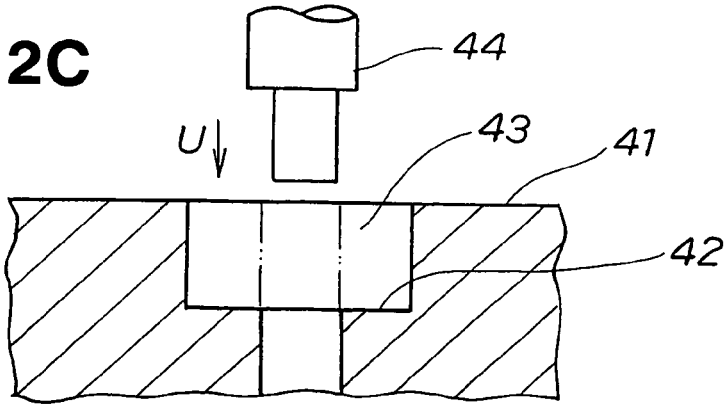

Steps from cutting of a titanium rod to cold punching are described according to FIG. 2A, FIG. 2B, and FIG. 2C.

First, as shown in FIG. 2A, a titanium rod 32 is carried on a base 31 of a shearing apparatus 30, and then the titanium rod 32 is cut out by a cutter 33 to obtain a forming material 34 as shown by arrow P.

In FIG. 2B, the forming material 34 is placed in a recess 37 of a die 36 of a metal mold 35, and then a bottom surface 39 of a punch 38 is moved as shown by arrow Q to upset the forming material 34 in the recess.

In FIG. 2C, the obtained upset piece 43 is set in a recess 42 of a die 41. Then, the upset piece 43 is subjected to punching by moving the punching tool 44 as shown by arrow U.

Figure 3A:
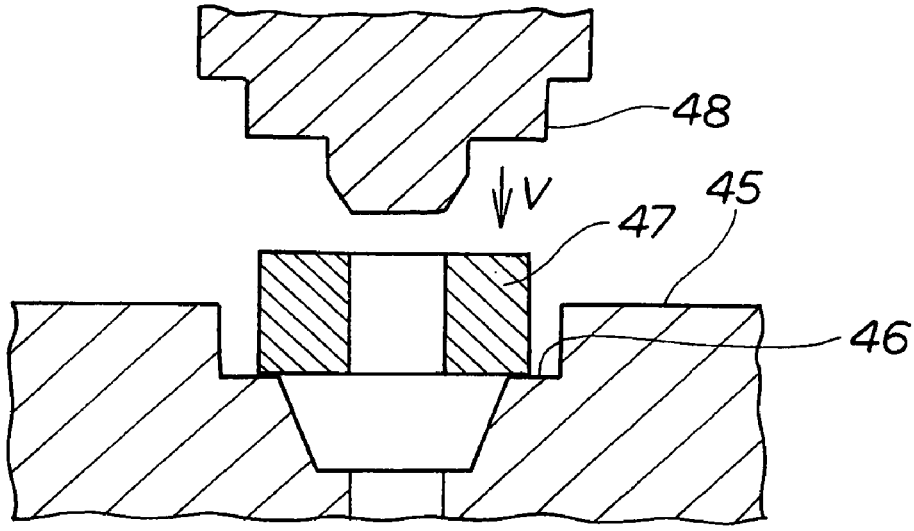
FIG. 3A and FIG. 3B are views showing steps from a preform of the spring retainer to finish forming.
Figure 3B:
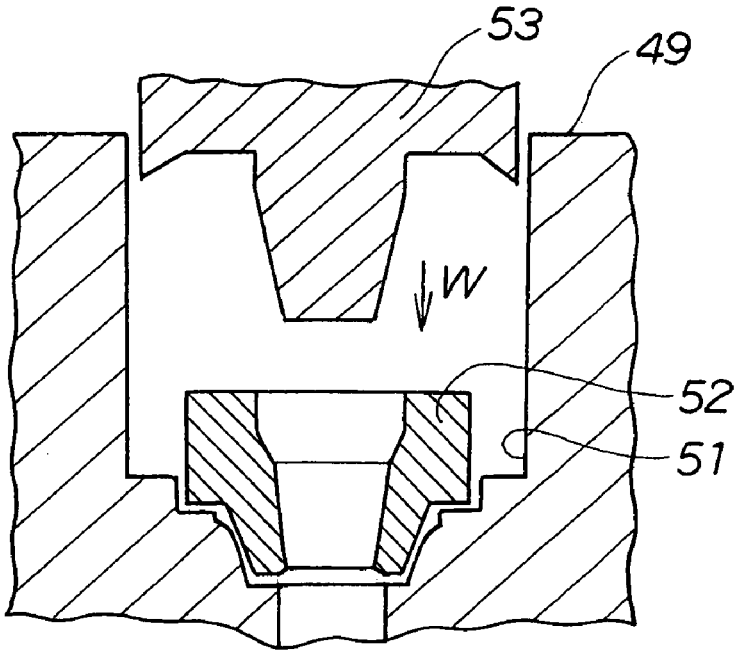

FIG. 3A and FIG. 3B show steps from the perform to finish forming of a spring retainer.

In FIG. 3A, a punched piece 47 is placed in a recess 46 of a die 45, and then a punch 48 is moved as shown by arrow V to cold-forge the punched piece 47 into the preform.

In FIG. 3B, the preform 52 is placed in a recess 51 of a die 49, and then a punch 53 is lowered as shown by arrow W to cold-forge the preform into the main spring retainer form or the finished form.

Each of the steps can be successively carried out using forging equipment such as a header machine, or can be carried out separately.

Figure 4:
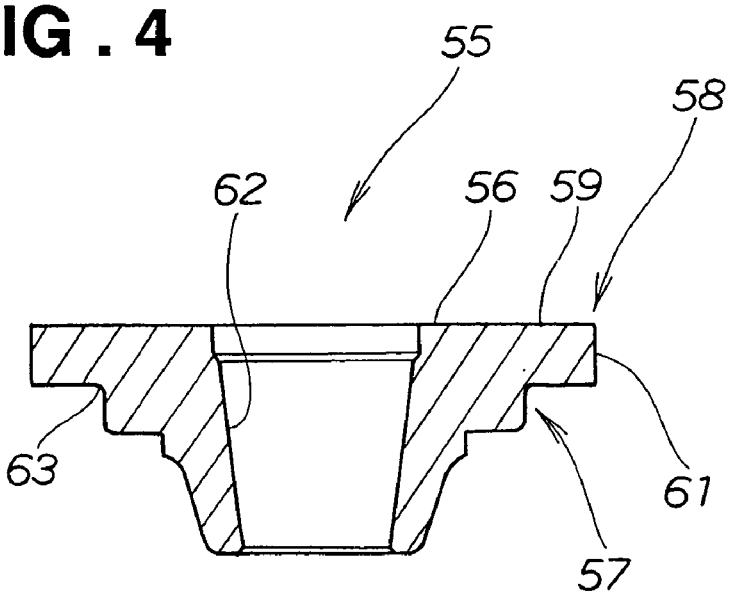
FIG. 4 is a sectional view of a type-A spring retainer considered in the invention.

FIG. 4 shows a type-A spring retainer 55.

The type-A spring retainer 55 is a component having a body 56 which comprises a cylinder 57, a brim 58 provided outside the cylinder, and a top 59 of the brim 58 which is beaten flat out to the outer peripheral end or edge 61 of the brim 58. Reference numeral 62 indicates a through-hole, and 63 indicates the brim base. The brim base 63 resides where a lower surface of the brim 58 intersects with an outer peripheral surface of the cylinder 57. The brim base 63 has a round shape. The spring retainer 55 shown in FIG. 4 is here referred to as configuration A.

Figure 5:
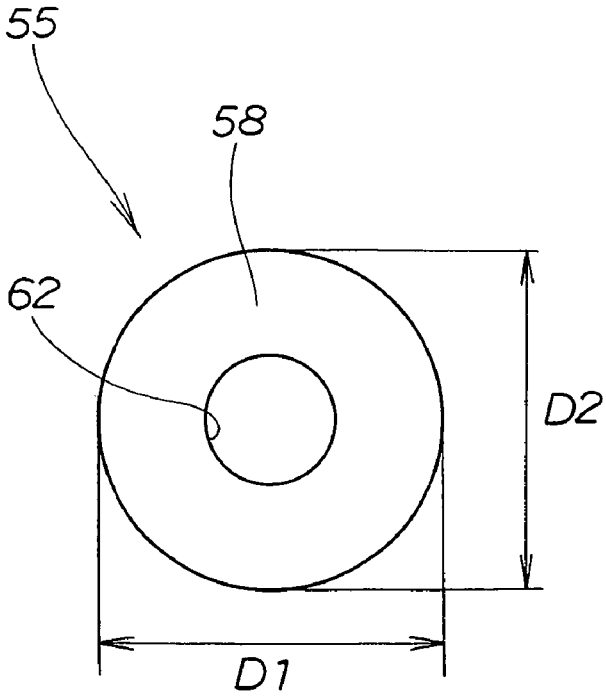
FIG. 5 is a plane view of FIG. 4.

As shown in FIG. 5, in the type-A spring retainer 55 used as a final product, the brim 58 preferably has a circular profile. However, when the brim 58 is subjected to stretch forming by cold forging, sometimes it has a distorted circular profile. Thus, to quantify the level of the distortion, oblateness of the outer diameter is obtained from the equation oblateness$=\{(D1-D2)/D1\}\times 100$, where the maximum diameter is D1 and the minimum diameter is D2. Of course, the smaller the oblateness of the outer diameter, the better.

A stick of (Ti-1Fe-0.3O)(oxygen of 0.3 mass percent) was used as starting material. The stick was subjected to cutting, and then subjected to upsetting, punching, preforming (cold forging), and main-forming (cold forging) as described, so that the type-A spring retainer 55 shown in FIG. 4 was obtained. The oblateness of the completed product was 8.9%. It is said that the allowable oblateness of the outer diameter is at most 1.0%; therefore, a retainer having oblateness of 8.9% could never be used.

Realizing that anisotropy is significant in the inexpensive titanium alloy Ti-1Fe-0.3O, the inventors investigated measures to deal with this anisotropy. One of several ideas considered was that when the brim 58 shown in FIG. 4 was expanded radially outward and fluidized, if the flow was appropriately controlled, the oblateness may possibly be improved. That is, it was considered that if flow at regions where the brim easily expands was suppressed, and flow at those regions was directed to regions where the brim does not readily expand, the outer diameter could be made uniform. Based on the idea, the following configuration B was determined.

Figure 6:
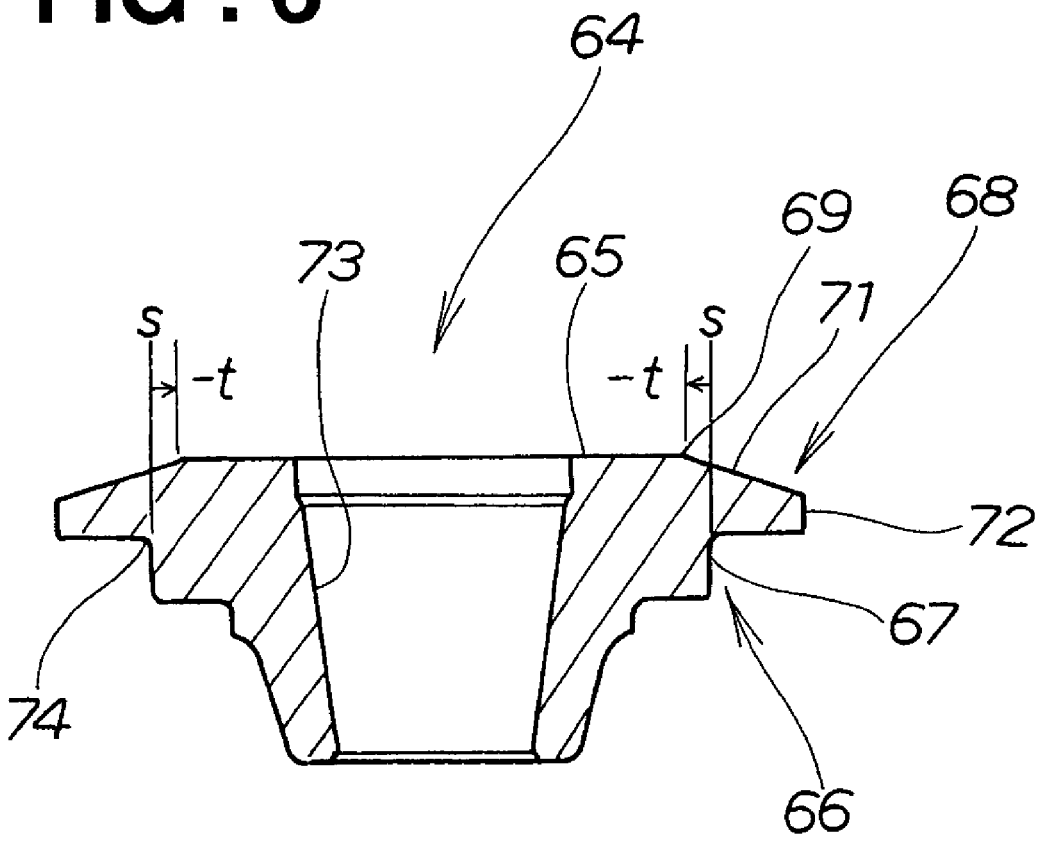
FIG. 6 is a sectional view of a type-B spring retainer considered in the invention.

FIG. 6 shows a type-B spring retainer 64.

The type-B spring retainer 64 is a component in which a body 65 has a cylinder 66; a brim 68 is provided outside of the outer peripheral surface 67 of the cylinder 66; and assuming that an extension line S extended upward from the outer peripheral surface 67 is the reference, and a position on a top of the body 65 that is displaced only −t toward the central axis of the cylinder 66 from the extension line S is made the compression starting position 69, a slope 71 inclined downward toward the edge 72 of the brim 68 with the compression starting point 69 as a starting point of the slope is provided. This shall be referred to as configuration B. A reference numeral 73 indicates a through-hole, while 74 indicates a brim base. The brim base 74 resides where the lower surface of the brim 68 intersects with the outer peripheral surface 67 of the cylinder 66. The brim base 74 has a round shape.

Table 1 shows results of the investigation on the oblateness of the outer diameters of the brims of the configurations A and B.

TABLE 1

| Test No. | Configuration | t (mm) | Oblateness of outer diameter of brim (%) | Roof shape of brim base |
|---|---|---|---|---|
| 1 | A | — | 8.9 | Excellent |
| 2 | B | −0.3 | 2.9 | Shrinkage |
| 3 | B | −0.7 | 2.8 | Shrinkage |
| 4 | B | −1.0 | 3.8 | Shrinkage |

t: distance from the edge of the cylinder to the taper starting point
Oblateness of outer diameter of brim (%): {(D1 − D2)/D1} × 100, less than 1.0% is acceptable
D1, D2: outer diameter of brim
—: no data because of no taper The sign t indicates distance from the outer edge of the cylinder to a taper starting point (hereinafter, referred to as compression starting position).

In test 1 which was a case of the configuration A and no taper, the oblateness of the outer diameter of the brim was 8.9%.

In tests 2 to 4, a configuration was B, and when t was −0.3 mm, 0.7 mm and −1.0 mm respectively, the oblateness of the outer diameters of the brims was 2.9%, 2.8% and 3.8%, respectively. In addition, shrinkage was evaluated by examination of shapes of the brim bases 74 (see FIG. 6).

In this way, the oblateness of the outer diameter of the brim was significantly improved by using the configuration B having the obliquely downward taper in the brim 68; however, it still did not reached an acceptability criterion of less than 1.0%.

The inventors posited that the slope 71 was excessively long in the configuration B, and as a result the oblateness was not as improved as expected and shrinkage was generated. If this is true, it is effective to investigate an intermediate configuration between the configurations A and B.

Figure 7:
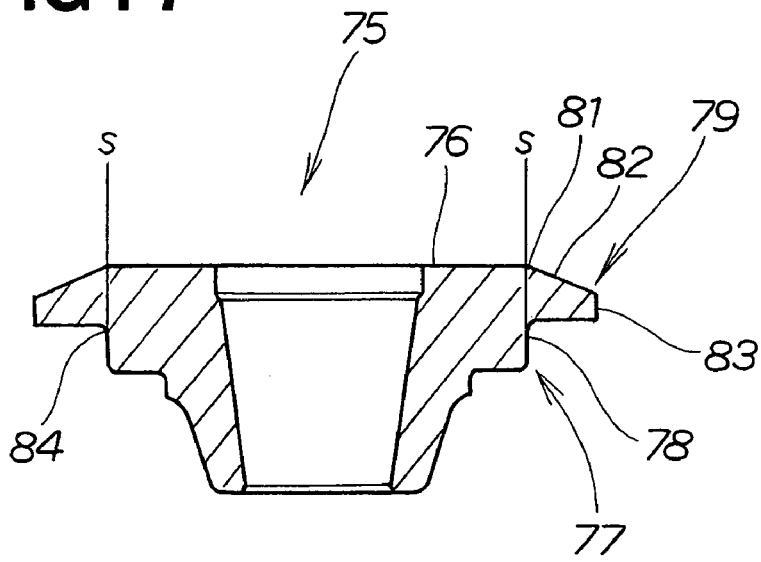
FIG. 7 is a sectional view of a type-C spring retainer considered in the invention.

FIG. 7 is a sectional view of a type-C spring retainer 75.

The type-C spring retainer 75 has a body 76 comprising a cylinder 77 and a brim 79 provided outside of the outer peripheral surface 78 of the cylinder 77; and the intersection between the extension line S extended upward from the outer cylinder side 78 and the body upper surface 76 is made the compression starting position 81. A slope 82 inclined downward toward the edge 83 of the brim 79 starting at the compression starting point 81 is provided. This is here called configuration C. Reference numeral 84 indicates the brim base. The brim base 84 reside in a position where the lower surface of the brim 79 intersects with the outer peripheral surface 78 of the cylinder 77. The brim base 84 has a round shape.

Figure 8:
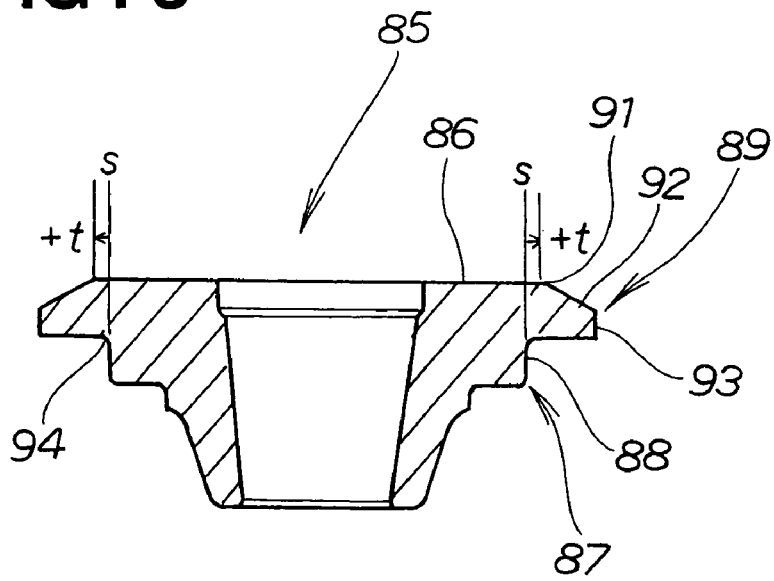
FIG. 8 is a sectional view of a type-D spring retainer considered in the invention.

FIG. 8 shows a type-D spring retainer 85.

The type-D spring retainer 85 is a component in which a body 86 has a cylinder 87; a brim 89 is provided outside of the outer peripheral surface 88 of the cylinder 87; and using the extension line S extended upward from the outer cylindrical side 88 as a reference, the position on a top of the body 86 which is located outside of the extension line S, displaced only +t toward the brim 89 from the extension line S, is made the compression starting position 91, a slope 92 inclined downward toward the outer edge 93 of the brim 89 with the compression starting point 91 as a starting point is provided. This here called configuration D. A reference numeral 94 is the brim base. The brim base 94 resides in a position where a lower surface of the brim 89 intersects with the outer peripheral surface 88 of the cylinder 87. The brim base 94 has a round shape.

Results of comparison between the type-C spring retainer and the type-D spring retainer are shown in Table 2.

TABLE 2

| Test No. | Configuration | t (mm) | Oblateness of outer diameter of brim (%) | Roof shape of brim base |
|---|---|---|---|---|
| 5 | C | 0 | 2.5 | Some shrinkage |
| 6 | D | 0.7 | 0.8 | Excellent |

t: distance from the outer peripheral surface of the cylinder to the taper starting point The sign t indicates distance from the outer circumference of the cylinder to the compression starting point.

In the test 5, which was a case where the configuration was C and t was 0 mm, although the oblateness of the outer diameter of the brim was improved to 2.5%, shrinkage was generated in the shape of the brim base 84.

In the test 6, which was a case that the configuration was D and t was 0.7 mm, the oblateness of the outer diameter of the brim was remarkably improved to 0.8%, in addition, the brim base 84 had excellent shape, with no shrinkage.

Consequently, the configuration D was determined to be used as the configuration of the spring retainer according to the invention.

As described above, the invention comprises a spring retainer for retaining one end of the valve spring for biasing the intake/exhaust valves to the closed position, and which has a brim that is stretch-formed from a cylinder, and receives the valve spring at the outer peripheral surface of the cylinder and the lower surface of the brim, wherein the spring retainer comprises a titanium alloy, and at least the finishing step is performed by cold forging, and the brim is compressed obliquely downward in the cold forging so that the thickness of the brim is decreased toward the outside in the radial direction.

As above, since it was found that the configuration D was preferable, next an additional experiment was conducted to find a preferable value of the distance t. Contents and results of the experiment are shown in Table 3.

TABLE 3

| Test No. | Configuration | t (mm) | Oblateness of outer diameter of brim (%) | R shape of brim base | Evaluation |
|---|---|---|---|---|---|
| 5 | C | 0 | 2.5 | Some shrinkage | X |
| 7 | D | 0.3 | 0.9 | Excellent | ○ |
| 8 | D | 0.5 | 0.9 | Excellent | ○ |
| 9 | D | 1.5 | 0.9 | Excellent | ○ |
| 10 | D | 2.0 | 3.3 | Excellent | X |

t: distance from the outer circumference of the cylinder to the taper starting point
Oblateness of outer diameter of the brim (%): {(D1 − D2)/D1} × 100, less than 1.0% is acceptable
D1, D2: outer diameters of the brim The configurations C and D were tested.

In the test 5, which was a case that the configuration was C and t was 0 mm, the oblateness of the outer diameter of the brim was 2.5%, and some shrinkage was generated in the shape of the brim base 84. Therefore, it was evaluated to be bad (hereinafter, abbreviated as x).

In the tests 7 to 9, which were cases that the configuration was C and when t was 0.3 mm, 0.5 mm and 1.5 mm respectively, the oblateness of the outer diameters of the brims was 0.9%, 0.9% and 0.9% respectively. Therefore, they were evaluated to be excellent (hereinafter, abbreviated as O).

In the test 10, which was a case that t was 2.0 mm, the oblateness of the outer diameter of the brim was 3.3% larger than the 1.0% acceptability criterion. Therefore, it was evaluated to be x.

Thus, t was determined to be 0.3 mm to 1.5 mm.

Next, conversion of the range of t 0.3 mm≦t≦1.5 mm into a general numerical formula for various spring retainers was attempted. In order to generalize the range of t with a numerical formula, reference was made to FIG. 9.

Figure 9:
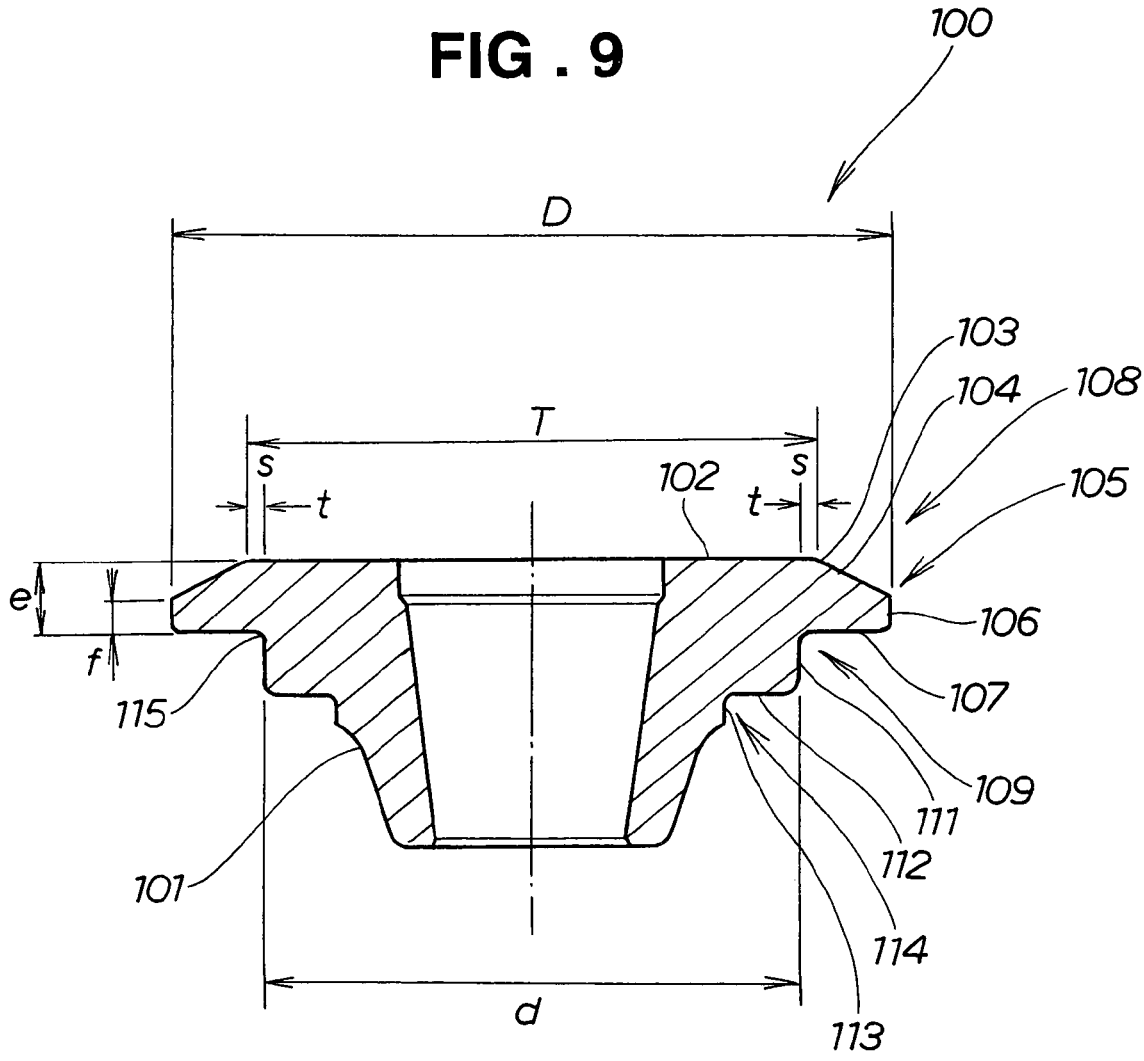
FIG. 9 is a sectional view of a spring retainer according to the invention.

A spring retainer 100 shown in FIG. 9 has a body 101 comprising a first cylinder 109 having a large diameter, a second cylinder 114 having a small diameter, and a brim 108 projecting radially outward from the outer peripheral surface 111 of the first cylinder 109.

Using the extension line S extended upward from the outer peripheral surface 111 of the first cylinder 109 as a reference, a position on a top 102 of the body 101 which is displaced by a distance t from the extension line S radially outward on the brim 101 is a compression starting point 103.

The top of the brim 108 is formed as a slope 104 inclined downward toward the outer edge 106 of the outer peripheral surface portion 105 of the brim 108, the slope starting from the compression starting point 103.

A lower surface 107 of the brim 108 and the outer peripheral surface 111 of the first cylinder 109 support one end of an outer spring (not shown).

A lower surface 112 of the first cylinder 109 connected to the above outer peripheral surface 111, and the outer peripheral surface 113 of the second cylinder 114 connected to the lower surface 112 support one end of an inner spring (not shown).

A reference numeral 115 indicates a brim base. The brim base 115 resides at a position where the lower surface 107 of the brim 108 intersects with the outer peripheral surface 111 of the first cylinder 109. The brim base 108 has a round shape.

Here, the outer diameter of the brim is D, the distance between radially opposing compression starting points 103 is T, the outer diameter of the first cylinder is d, and the distance from the outer peripheral surface 111 of the first cylinder 109 to the compression starting point 103 is t. T is set in proportion to D.

Hereinafter, basic equations of D, T, d and t are shown in equation (1) and equation (2).

$$(D-T)/D \tag{1}$$

$$T=d+2t \tag{2}$$

The equation (2) is substituted into the equation (1), thereby equation (3) is derived.

$$(D-(d+2t))/D \tag{3}$$

Here, assuming that D=21 mm and d=16 mm, these values are substituted into the equation (3) along with a maximum value of t of 1.5 mm or a minimum value of t of 0.3 mm, so that equation (4) and equation (5) are obtained.

$$(D-(d+2t))/D=(21-(16+2\times1.5))/21=0.095 \tag{4}$$

$$(D-(d+2t))/D=(21-(16+2\times0.3))/21=0.21 \tag{5}$$

The equation (4) is transformed to obtain equation (6) expressing the maximum value of t in terms of D and d.

$$D-(d+2t)=0.095D$$

$$-(d+2t)=0.095D-D=-0.905D$$

$$2t=0.905D-d$$

$$t=0.453D-0.5d \tag{6}$$

The equation (5) is transformed to obtain equation (7) expressing the minimum value of t in terms of D and d.

$$D-(d+2t)=0.21D$$

$$-(d+2t)=0.21D-D=-0.79D$$

$$2t=0.79D-d$$

$$t=0.395D-0.5d \tag{7}$$

Since the equation (6) expresses the maximum value of t, and the equation (7) expresses the minimum value of t, the range of t is generalized by the numeral formula (8):

$$(0.395D-0.5d)\leqq t\leqq(0.453D-0.5d) \tag{8}$$

When D=21 mm and d=16 mm are substituted into the equation (8), t is given as approximately 0.3 mm≦t≦1.5 mm.

The above is summarized as follows: the slope formed on the brim is to start at a position separated from the outer peripheral surface of the cylinder by distance t in the radially outward direction, and the distance t is determined so that (0.395D−0.5d)≦t≦(0.453D−0.5d), where the outer circumference of the brim is D, and the outer circumference of the cylinder is d.

Next, detailed investigation was conducted to determine the type of the titanium alloy used for the spring retainer. As the titanium alloy to be used, an α-type titanium alloy, which can be cold-forged and which contains a small amount of iron (hereinafter, referred to as Fe), oxygen (hereinafter, referred to as O) in addition to titanium (hereinafter, referred to as Ti), was investigated.

Table 4 shows results of the investigation for determining the amount of Fe in the Ti—Fe—O-based titanium alloy.

TABLE 4

| Test No. | Configuration | t (mm) | Alloy composition (mass percent) Fe | O | Ti | Presence of crack | Oblateness of outer diameter of brim (%) | evaluation |
|---|---|---|---|---|---|---|---|---|
| 11 | D | 1.0 | 0.3 | 0.4 | remainder | none | 2.6 | X |
| 12 | D | 1.0 | 0.5 | 0.4 | remainder | none | 0.8 | ○ |
| 13 | D | 1.0 | 1.0 | 0.4 | remainder | none | 0.9 | ○ |
| 14 | D | 1.0 | 1.0 | 0.4 | remainder | none | 0.8 | ○ |
| 15 | D | 1.0 | 1.0 | 0.4 | remainder | present | — | X |

—: no data
t: distance from the outer peripheral surface of the cylinder to the taper starting point
Oblateness of outer diameter of brim (%): {(D1 − D2)/D1} × 100; less than 1.0% is acceptable
D1, D2: outer diameter of brim In any of them, the configuration is D, and t, which is the distance from the outer peripheral surface of the cylinder to the compression starting point, is 1.0 mm.

In the test 11 which was a titanium alloy containing Fe 0.3 mass percent, O 0.4 mass percent, the remainder being Ti, while cracks were not present after cold forging, the oblateness of the outer diameter of the brim was 2.6%, beyond the acceptability criterion of less than 1.0%. Therefore, it was evaluated as x.

In the tests 12 to 14 which were titanium alloys whose Fe content was 0.5 mass percent, 1.0 mass percent, and 1.5 mass percent respectively, and with O 0.4 mass percent the remainder being Ti, cracks were not present after cold forging, and the oblateness of the outer diameter of the brim was 0.8%, 0.9% and 0.8% respectively, within the acceptability criterion of less than 1.0%. Therefore, they were evaluated as O.

In the test 15 which was a titanium alloy containing Fe 1.7 mass percent, O 0.4 mass percent, the remainder being Ti, cracks were present after cold forging. Therefore, it was evaluated as x.

Thus, the amount of Fe in the Ti—Fe—O-based titanium alloy was determined to be 0.5 mass percent to 1.5 mass percent.

Similarly, Table 5 shows results of the investigation for determining the amount of O in the Ti—Fe—O-based titanium alloy.

TABLE 5

| Test No. | Configuration | t (mm) | Alloy composition (mass percent) Fe | O | Ti | Presence of crack | Strength of simple alloy | evaluation |
|---|---|---|---|---|---|---|---|---|
| 16 | D | 1.0 | 1.0 | 0.1 | remainder | none | X | X |
| 17 | D | 1.0 | 1.0 | 0.2 | remainder | none | ○ | ○ |
| 18 | D | 1.0 | 1.0 | 0.3 | remainder | none | ○ | ○ |
| 19 | D | 1.0 | 1.0 | 0.5 | remainder | none | ○ | ○ |
| 20 | D | 1.0 | 1.0 | 0.6 | remainder | present | — | X |

—: no data
t: distance from the outer peripheral surface of the cylinder to the taper starting point In all of these, the configuration is D, and t, which is the distance from the outer peripheral surface of the cylinder to the compression starting point, is 1.0 mm.

In the test 16 which was a titanium alloy containing Fe 1.0 mass percent, O 0.1 mass percent, the remainder being Ti, while cracks were not present after cold forging, the strength of simple alloy was weak. Therefore, it was evaluated as x.

In the tests 17 to 19 which were titanium alloys containing Fe 1.0 mass percent, and whose O content was 0.2 mass percent, 0.3 mass percent, and 0.5 mass percent respectively, the remainder being Ti, cracks were not present after cold forging, and the strength of simple alloy was strong. Therefore, they were evaluated as O.

In the test 20 which was a titanium alloy containing Fe 1.0 mass percent, O 0.6 mass percent, the remainder being Ti, cracks were present after cold forging. Therefore, it was evaluated as x.

Consequently, the amount of O in the Ti—Fe—O-based titanium alloy is determined to be 0.2 mass percent to 0.5 mass percent.

The results of Table 4 and Table 5 are summarized in that the titanium alloy comprises α-type titanium alloy containing 0.5 to 1.5 mass percent of iron, and 0.2 to 0.5 mass percent of oxygen in addition to titanium, and also contains inevitable impurities.

Generally, in the titanium alloy used for the spring retainer, N is sometimes added to make a Ti—Fe—O—N-based titanium alloy, for the purpose of increasing strength of the Ti—Fe—O-based titanium alloy. Thus, investigation for determining the amount of N in the Ti—Fe—O—N-based titanium alloy was conducted.

Table 6 shows results of the investigation for determining the amount of N.

TABLE 6

| Test No. | Configuration | t (mm) | Alloy composition (mass percent) Fe | O | N | Ti | Presence of crack | Strength of simple alloy | evaluation |
|---|---|---|---|---|---|---|---|---|---|
| 21 | D | 1.0 | 1.0 | 0.3 | 0.01 | remainder | none | ○ | ○ |
| 22 | D | 1.0 | 1.0 | 0.3 | 0.03 | remainder | none | ○ | ○ |
| 23 | D | 1.0 | 1.0 | 0.3 | 0.06 | remainder | none | ○ | ○ |
| 24 | D | 1.0 | 1.0 | 0.3 | 0.08 | remainder | present | — | X |

—: no data
t: distance from the outer circumference of the cylinder to the taper starting point In all of these, the configuration is D, the distance t from the outer peripheral surface of the cylinder to the compression starting point is 1.0 mm, and Fe 1.0 mass percent and O 0.3 mass percent are contained.

In the tests 21 to 23 which were titanium alloys with N content of 0.01 mass percent, 0.03 mass percent, and 0.06 mass percent respectively, the remainder being Ti, cracks were not present after cold forging and the strength of simple alloy was strong. Therefore, they were evaluated as O.

In the test 24 which was a titanium alloy containing N 0.08 mass percent, cracks were present after cold forging. Therefore, it was evaluated as x.

Thus, the amount of N in the Ti—Fe—O—N-based titanium alloy was determined to be 0.01 mass percent to 0.06 mass percent.

Summarizing the results of Table 4, Table 5 and Table 6, the titanium alloy is a α-type titanium alloy containing 0.5 to 1.5 mass percent of iron, 0.2 to 0.5 mass percent of oxygen, and 0.01 to 0.06 mass percent of nitrogen in addition to titanium and other inevitable impurities.

From the above investigations, it was determined that in the completed spring retainer, at least the finishing step was carried out by cold forging, the brim having a constant thickness was compressed in the cold forging such that the thickness was decreased toward the outside in the radial direction, and an inexpensive titanium alloy was used.

In FIG. 9, thickness of the central base portion of the brim 108 is here called "maximum thickness e of the brim", and thickness of the outer peripheral edge 106 that is the edge of the brim 108 is here called "edge thickness f of the brim". A relation between the base having the maximum thickness and the edge having the minimum thickness is an important factor for determining a section profile of the brim 108. Thus, the relation between the maximum thickness e and the edge thickness f was investigated. Contents and results of the investigation are shown in Table 7. Since the following tests were carried out after performing tests 25 to 29 described later, they were given test numbers 30 to 35.

TABLE 7

| Test No. | Configuration | t (mm) | Maximum thickness e of brim (mm) | Edge thickness f of brim (mm) | (f/e) × 100 (%) | Formability | Evaluation |
|---|---|---|---|---|---|---|---|
| 30 | D | 1.0 | 1.7 | 0.6 | 35 | Bad shape | X |
| 31 | D | 1.0 | 1.7 | 0.7 | 41 | Excellent | ○ |
| 32 | D | 1.0 | 1.7 | 0.8 | 47 | Excellent | ○ |
| 33 | D | 1.0 | 1.7 | 1.0 | 59 | Excellent | ○ |
| 34 | D | 1.0 | 1.7 | 1.2 | 70 | Excellent | ○ |
| 35 | D | 1.0 | 1.7 | 1.5 | 88 | Bad shape | X |

In all of these, the configuration is D, the distance t from the outer peripheral surface of the cylinder to the compression starting point is 1.0 mm, and the maximum thickness e of the brim is 1.7 mm.

The test 30 is a case where the edge thickness f is 0.6 mm, and f/e is 35%. In the forming test, material was insufficiently filled into clearance for forming the edge, and accordingly the shape of the brim was defective. Therefore, it was evaluated as x.

In the tests 31 to 34 which were cases where the edge thickness f of the brims was 0.7 mm, 0.8 mm, 1.0 mm and 1.2 mm, and f/e was 41%, 47%, 59% and 70%, respectively, results of the forming tests were excellent. Therefore, they were evaluated as O.

The test 35 is a case where the edge thickness f of the brim is 1.5 mm, and f/e is 88%. In the forming test of it, the effect of suppressing the anisotropy of the deformation by the slope was insufficient, accordingly a bad shape appeared in relief. Therefore, it was evaluated as x.

From the above results, when thickness of the base of the brim 108 is the "maximum thickness e of the brim", and thickness of the edge of the brim 108 (outer peripheral edge 106) is the "edge thickness f of the brim", it is important that the edge thickness f of the brim is set to 41% to 70% of the maximum thickness e of the brim, and the shape of the brim can be made excellent by setting the thickness f within this range.

As shown in FIG. 3B, a punch 53 having a sharp edge is used to realize the invention. However, the more the edge of the punch is sharpened, the shorter its useful life (the number of shots), which affects productivity. Thus, the shape of the punch is here investigated.

Figure 10A:
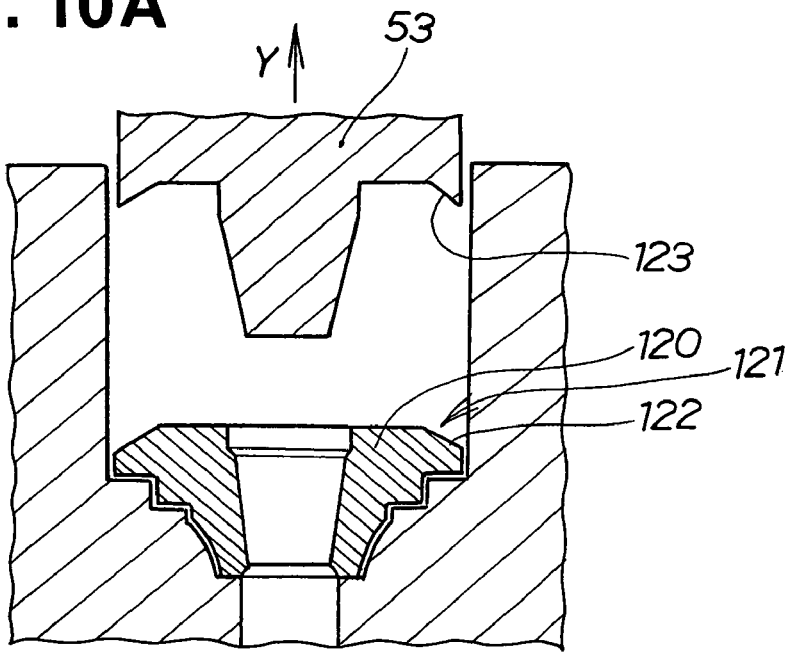
FIG. 10A and FIG. 10B are views showing a shape of a punch according to the invention.
Figure 10B:
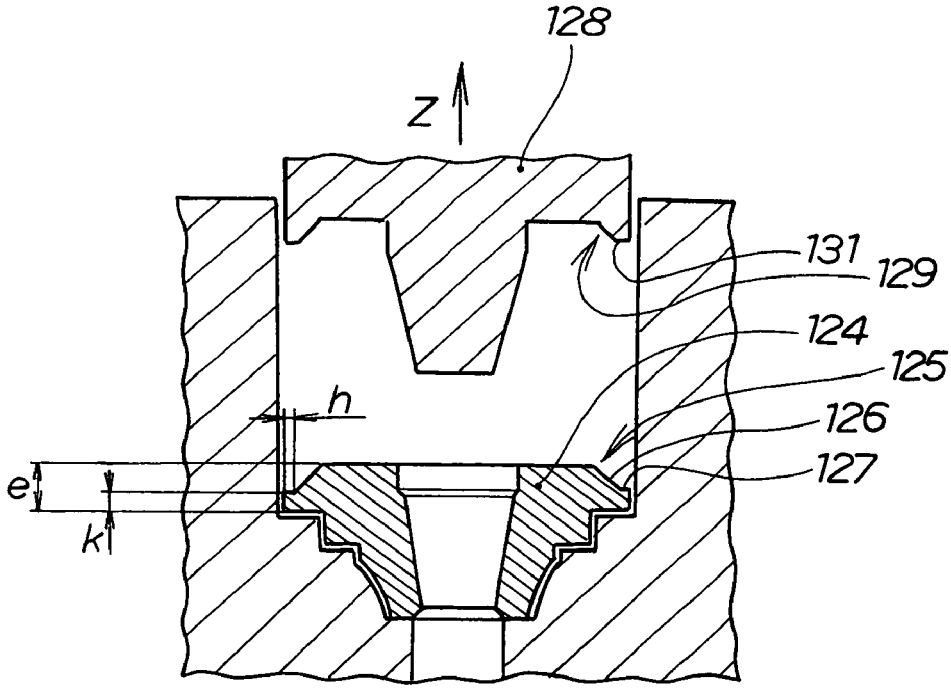
Figure 11:
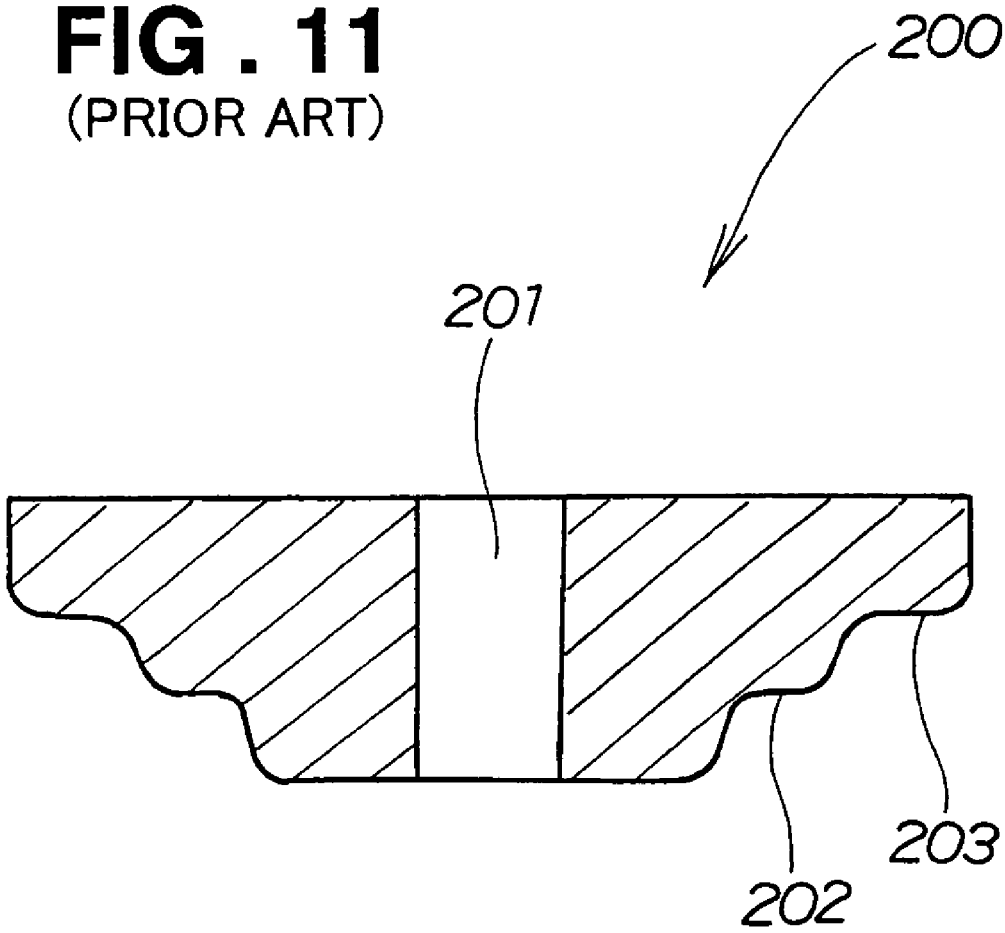
FIG. 11 (PRIOR ART)
FIG. 11 is a sectional view showing a spring retainer in the related art.

FIG. 10A and FIG. 10B show shapes of punches according to the invention.

As shown in FIG. 10A, a slope 122 of a brim 121 of a spring retainer 120 is machined using an inclined portion 123 of a punch 53, and then the punch 53 is drawn apart from the spring retainer 120 as shown by an arrow Y In this case, although the slope 122 can be formed on the brim 121 of the spring retainer 120, the tip of the inclined portion 123 of the punch 53 becomes more round as the punch is repeatedly used, which may cause decrease in the useful life of the metal mold. Thus, the punch was improved in the following way.

FIG. 10B shows a condition where relief portion 127, provided on brim 125 of a spring retainer 134, along with slope 126, is machined using an inclined portion 129 and a horizontal surface 131 formed on a punch 128, and then the punch 128 is drawn away from the spring retainer 124 as shown in an arrow Z.

In FIG. 10B, e is a maximum thickness of the brim 125, k is a thickness of the relief portion 127, and h is a width of the relief portion 127.

In this way, since the relief portion 127 having a constant thickness is formed on the outer edge of the brim 125, the edge of the punch 128 is not deformed regardless of how long it is used. As a result, uniformity of the diameter of the brim 125 is improved.

From the above, it was found that accuracy of the outer circumference of the brim 125 was improved by forming the relief portion 127, and subsequently additional tests were conducted to find the optimum thickness k of the relief 127. Contents and results of the tests are shown in Table 8.

TABLE 8

| Test No. | Configuration | t (mm) | Maximum thickness e of brim (mm) | Thickness k of relief (mm) | (k/e) × 100 (%) | Formability | Evaluation |
|---|---|---|---|---|---|---|---|
| 25 | D | 1.0 | 1.7 | 0.6 | 35 | Bad shape of relief | X |
| 26 | D | 1.0 | 1.7 | 0.8 | 47 | Excellent | ○ |
| 27 | D | 1.0 | 1.7 | 1.0 | 59 | Excellent | ○ |
| 28 | D | 1.0 | 1.7 | 1.2 | 70 | Excellent | ○ |
| 29 | D | 1.0 | 1.7 | 1.5 | 88 | Bad shape in relief | X |

t: distance from the outer circumference of the cylinder to the taper starting point In all of these, the configuration is D, the distance t from the outer peripheral surface of the cylinder to the taper starting position is 1.0 mm, and the thickness of the brim is 1.7 mm.

The test 25 is the case where the thickness k of the relief is 0.6 mm, and ratio of the thickness k of the relief to the maximum thickness e of the brim is 35%. In this forming test, since material did not uniformly enter the clearance for forming the relief, the resulting relief had a bad shape. Therefore, it was evaluated as x.

In the tests 26 to 28, the thickness k of the relief was 0.8 mm, 1.0 mm and 1.2 mm respectively, and ratio of the thickness k of the relief to the maximum thickness e of the brim was 47%, 59% and 70% respectively, and results of the forming tests were excellent. Therefore, they were evaluated as O.

While not shown in Table 8, the oblateness of the outer diameter of the brim was 0.5% in the tests 26 to 28.

The test 29 is a case where the thickness k of the relief 127 is 1.5 mm, and the ratio of the thickness k of the relief to the maximum thickness e of the brim is 88%. In the forming test, suppression of the anisotropy of the deformation by the slope was insufficient, and the resulting relief had a bad shape. Therefore, it was evaluated as x.

From the above results, the thickness k of the relief 127 needs to be set to 47 to 70% of the maximum thickness e of the brim 125.

Since the width h of the relief 127 was set to be a size that does not exceed 30% of length of the slope formed on the brim 125, the uniformity of the outer diameter can be improved with certainty.

That is, the brim includes the relief having a constant thickness formed on the outer peripheral edge.

Furthermore, the width of the relief is set to be at most 30% of the length of the slope formed on the brim.

Moreover, the brim is compressed obliquely downward in the cold forging so that thickness is decreased toward the outside in the radial direction. As a result, even if the α-type titanium alloy having large deformation anisotropy is used for the material, the shrinkage that tends to be generated at the brim base after forming by cold forging can be suppressed, and the anisotropy of the outer diameter can be also suppressed.

The type of the engine to which the spring retainers 100, 124 of the invention are applied is not particularly limited, as long as the engine has an intake valve and exhaust valve.

Obviously, various minor changes and modifications of the present invention are possible in the light of the above teaching. It is therefore to be understood that within the scope of the appended claims the invention may be practiced otherwise than as specifically described.

What is claimed is:

1. A spring retainer for retaining one end of a valve spring for biasing intake/exhaust valves to a closed position, comprising a cylinder, a brim formed integrally with the cylinder and extending radially outward from an upper end of the cylinder, wherein the spring retainer comprises a titanium alloy formed by cold forging at least in the finishing process, and a slope formed on a top of the brim by compressing the brim obliquely downwardly during the cold forging such that the brim has a thickness decreasing in a radially outward direction, wherein the titanium alloy comprises an α-type titanium alloy containing 0.5 to 1.5 mass percent of iron and 0.2 to 0.5 mass percent of oxygen in addition to titanium and other inevitable impurities.

2. A spring retainer for retaining one end of a valve spring for biasing intake/exhaust valves to a closed position, comprising a cylinder, a brim formed integrally with the cylinder and extending radially outward from an upper end of the cylinder, wherein the spring retainer comprises a titanium alloy formed by cold forging at least in the finishing process, and a slope formed on a top of the brim by compressing the brim obliquely downwardly during the cold forging such that the brim has a thickness decreasing in a radially outward direction, wherein the titanium alloy comprises an α-type titanium alloy containing 0.5 to 1.5 mass percent of iron, 0.2 to 0.5 mass percent of oxygen, and 0.01 to 0.06 mass percent of nitrogen in addition to titanium and other inevitable impurities.

3. A spring retainer for retaining one end of a valve spring for biasing intake/exhaust valves to a closed position, comprising a cylinder, a brim formed integrally wilt the cylinder and extending radially outward from an upper end of the cylinder, wherein the spring retainer comprises a titanium alloy formed by cold forging at least in the finishing process, and a slope formed on a top of the brim by compressing the brim obliquely downwardly during the cold forging such that the brim has a thickness decreasing in a radially outward direction, wherein the slope of the brim runs from a position radially outwardly spaced a distance t from an outer peripheral surface of the cylinder, the distance t being set based on $(0.395D-0.5d) \leqq t \leqq (0.453D-0.5d)$, where D is an outer diameter of the brim, and d is an outer diameter of the cylinder.

4. A spring retainer for retaining one end of a valve spring for biasing intake/exhaust valves to a closed position, comprising a cylinder, a brim formed integrally with the cylinder and extending radially outward from an upper end of the cylinder, wherein the spring retainer comprises a titanium alloy formed by cold forging at least in the finishing process, and a slope formed on a top of the brim by compressing the brim obliquely downwardly during the cold forging such that the brim, has a thickness decreasing in a radially outward direction, wherein the brim has a distal end of a width set to fall in a range of 41% to 70% of a maximum thickness of the brim.

5. A spring retainer for retaining one end of a valve spring for biasing intake/exhaust valves to a closed position, comprising a cylinder, a brim formed integrally with the cylinder and extending radially outward from an upper end of the cylinder, wherein the spring retainer comprises a titanium alloy formed by void forging at least in the finishing process, and a slope formed on a top of the brim by compressing the brim obliquely downwardly during to cold forging such that the brim has a thickness decreasing in a radially outward direction, wherein the brim has a relief portion of a constant width provided at an outer peripheral end thereof.

6. A spring retainer according to claim 5, wherein the relief portion has a width set to be at most 30% of a length of the slope of the brim.

7. A method for manufacturing a spring retainer which comprises a cylinder and a brim projecting outwardly therefrom and is designed for supporting one end of a valve spring with an outer peripheral surface of the cylinder and a lower surface of the brim, the method comprising the steps of:

cutting a titanium blank in the form of a wire or rod to obtain a forming material, upsetting the forming material placed in a recess of a die of a metal mold by a bottom surface of a punch, punching a hole in the upset piece after the upsetting, obtaining a preform by cold forging the punched piece placed in the recess of the die using a punch, and forming the brim such that a thickness of the brim decreases in a radially outward direction by cold forging the preform placed in the recess of the die using the punch.

* * * * *